US006384008B1

(12) United States Patent
Parry

(10) Patent No.: US 6,384,008 B1
(45) Date of Patent: May 7, 2002

(54) NON-AQUEOUS LIQUID DETERGENT COMPOSITIONS CONTAINING ETHOXYLATED QUATERNIZED AMINE CLAY COMPOUNDS

(75) Inventor: Diane Parry, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/555,932

(22) PCT Filed: Dec. 14, 1998

(86) PCT No.: PCT/IB98/01996

§ 371 Date: Jun. 6, 2000

§ 102(e) Date: Jun. 6, 2000

(87) PCT Pub. No.: WO99/29827

PCT Pub. Date: Jun. 17, 1999

Related U.S. Application Data

(60) Provisional application No. 60/069,261, filed on Dec. 11, 1997.

(51) Int. Cl.[7] ..... C11D 1/62; C11D 1/22; C11D 3/43

(52) U.S. Cl. ..... 510/414; 510/276; 510/289; 510/299; 510/300; 510/304; 510/320; 510/338; 510/341; 510/371; 510/374; 510/392; 510/400; 510/407; 510/432; 510/332; 510/499; 510/504; 510/351; 510/357

(58) Field of Search ..... 510/276, 289, 510/299, 300, 304, 320, 338, 341, 371, 374, 392, 400, 407, 432, 332, 499, 504, 414, 351, 357

(56) References Cited

U.S. PATENT DOCUMENTS

| | | | | |
|---|---|---|---|---|
| 4,931,195 A | | 6/1990 | Cao et al. | 252/8.8 |
| 5,872,091 A | * | 2/1999 | Cuperus et al. | 510/300 |

FOREIGN PATENT DOCUMENTS

| | | | | |
|---|---|---|---|---|
| EP | 0 133 071 A2 | | 2/1985 | C09C/1/42 |
| EP | 0 635 569 A2 | | 1/1995 | C11D/17/00 |
| EP | 0 738 778 A1 | | 10/1996 | C11D/17/00 |
| WO | WO 95/35362 | | 12/1995 | C11D/3/386 |
| WO | WO 97/00936 | | 1/1997 | C11D/17/00 |
| WO | 97/00936 | * | 1/1997 | |

* cited by examiner

*Primary Examiner*—Charles Boyer
(74) *Attorney, Agent, or Firm*—C. Brant Cook; Kim W. Zerby; Steven W. Miller

(57) ABSTRACT

Non-aqueous, particulate-containing heavy duty liquid laundry detergent compositions that are in the form of a stable suspension of particulate material, essentially including from about 0.1% to about 10%, by weight of the detergent composition of an ethoxylated quaternized amine clay material. These compositions preferably include a peroxygen bleaching agent and an organic detergent builder, dispersed in a liquid phase preferably structured with a surfactant. Such compositions provide especially desirable cleaning and bleaching of fabrics laundered therewith and also exhibit especially desirable aesthetics.

2 Claims, No Drawings

NON-AQUEOUS LIQUID DETERGENT COMPOSITIONS CONTAINING ETHOXYLATED QUATERNIZED AMINE CLAY COMPOUNDS

This application claims the benefit of U.S. Provisional Application No. 60/069,261 filed Dec. 11, 1997.

FIELD OF THE INVENTION

This invention relates to liquid laundry detergent products which are non-aqueous in nature and which are in the form of stable dispersions of particulate material. The detergent compositions include low and/or high melting point ethoxylated quaternized clay detergent actives and preferably also include other materials such as bleaching agents and/or conventional detergent composition adjuvants.

BACKGROUND OF THE INVENTION

In the past, the use of certain ethoxylated materials in an anhydrous liquid composition has resulted in the liquid thickening at low temperatures and/or thinning at high temperature. When the anhydrous liquid composition is a consumer product, for example, a liquid laundry composition, the change in physical characteristics with changes in temperature is an undesirable, if not an unacceptable, effect. Unfortunately, however, certain ethoxylated materials are known to provide many cleaning benefits in laundry compositions. But to avoid the undesirable changes in viscosity with changes in temperature, the use of certain ethoxylated materials has been avoided in anhydrous liquid compositions.

Given the foregoing, there is a continuing need to identify materials and procedures which can be used to achieve a consistent viscosity profile for non-aqueous liquid detergent products within the normal usage temperature range for these products. Accordingly, it is an object of the present invention to formulate non-aqueous heavy-duty detergent compositions which remain liquid within the temperature range of from about 4° C. to about 35° C.

Surprisingly it has been found that there is a small class of ethoxylated quaternized amine clay materials having the requisite degree of ethoxylation, which can provide a clay cleaning benefit while achieving the forgoing objectives with respect to the liquid detergent products herein.

SUMMARY OF THE INVENTION

The present invention provides non-aqueous liquid detergent compositions comprising a stable suspension of solid, substantially insoluble particulate material dispersed throughout a non-aqueous, surfactant-containing liquid phase. Such compositions comprise: A) from about 49% to 99.95% by weight of the composition of a surfactant-containing, preferably structured, non-aqueous liquid phase; B) from about 0.1% to about 10%, by weight of the detergent composition of an ethoxylated quaternized amine clay material.

Compositions of the present invention preferably comprise from about 1% to 44% by weight of the composition of additional insoluble particulate material which ranges in size from about 0.1 to 1500 microns. The particulate material is preferably substantially insoluble in the liquid phase and the particulate material is selected from peroxygen bleaching agents, bleach activators, organic detergent builders, inorganic alkalinity sources, colored speckles and combinations thereof Moreover, the structured, surfactant-containing liquid phase is preferably formed by combining: i) from about 1% to 80% by weight of said liquid phase of one or more non-aqueous organic diluents; and ii) from about 20% to 99% by weight of said liquid phase of a surfactant selected from anionic, nonionic and cationic surfactants and combinations thereof.

In detergent compositions, it is preferable to use materials which do not change between liquid and solid phase over the normal usage temperature range. This insures physical stability of the detergent compositions. Selecting clay cleaning agents based on their melting points provides a non-aqueous product that provides a consumer benefit while maintaining physical stability. Moreover, it has surprisingly been found that when certain ethoxylated quaternized amine clay materials, with specific degrees of ethoxylation, are used in the non-aqueous, heavy duty liquid detergent compositions of the present invention, the product remains liquid over the normal usage temperature range. Additionally, the ethoxylated quaternized amine clay materials provide acceptable to improved cleaning benefits when used in the non-aqueous, heavy duty liquid detergent compositions of the present invention.

DETAILED DESCRIPTION OF THE INVENTION

The non-aqueous liquid detergent compositions of this invention comprise a surfactant-containing, liquid phase in which solid, substantially insoluble particles are suspended. The essential and optional components of the liquid phase and the solid dispersed particles and other optional materials of the detergent compositions herein, as well as composition form, preparation and use, are described in greater detail as follows: (All concentrations and ratios are on a weight basis unless otherwise specified.)

It is envisioned that the non-aqueous, heavy duty liquid detergent compositions of the present invention will be used, that is, transported and stored, at temperatures in the range of from about 4° C. to about 35° C. It is especially important that these detergent compositions remain pourable within this temperature range. To maintain a pourable viscosity profile the non-aqueous, liquid, heavy-duty detergent compositions of the present invention comprise from about 0.1% to about 10%, preferably 0.5% to about 5%, and most preferably 0.5% to 3%, by weight of the detergent composition, an ethoxylated quaternized amine clay material.

Preferred ethoxylated quaternized amine clay materials are selected from the group consisting of compounds having the general formula:

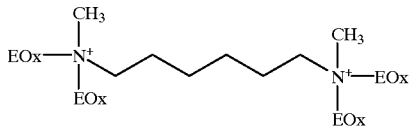

wherein each x is independently less than about 16, preferably from about 6 to about 13, more preferably from about 6 to about 8, or wherein each x is independently greater than about 35. Materials suitable for use in the present invention, such as those defined above, can be purchased from the BASF Corporation in Germany, and the Witco Chemical Company.

It has been determined that the degree of ethoxylation is important to the viscosity of the final detergent compositions described herein. Specifically, for the general structure:

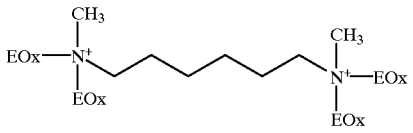

when x is less than about 13 the ethoxylated quaternized amine clay materials can be added to the present non-aqueous, liquid heavy duty detergent compositions as liquids without causing undesired thickening at low temperatures. Likewise, when the degree of ethoxylation for the same structure is greater than about 35, that is when x is greater than about 35, these higher ethoxylated materials can be added to non-aqueous formulations as stable solid without melting at high temperatures and without causing low temperature product thickening.

Additionally preferred ethoxylated quaternized amine clay materials for use in the present invention are those having the general formula:

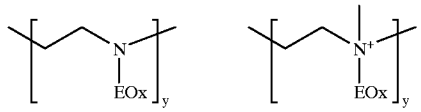

wherein x is from about 10 to about 14, y is from about 12 to about 16, and from about 16% to about 24% of the nitrogens are quaternized. Materials of this general structure are often referred to as a "PEI" because they are polyethylenimine based materials. Preferred PEI compounds for use in the present invention have an average molecular weight of from about 400 to about 800, more preferably the molecular weight is about 600. Example III, below, details one method of producing these materials and other synthesis methods will be apparent to those skilled in the art.

Not only do these materials help stabilize the viscosity profile of the liquid detergent compositions described herein, but they provide clay cleaning benefits as well. The particulate-containing non-aqueous liquid detergent compositions herein will be relatively viscous and phase stable under conditions of commercial marketing and use of such compositions. Frequently the viscosity of the compositions herein will range from about 300 to 4,500 cps, more preferably from about 500 to 3,000 cps.

The viscosity of the detergent compositions described herein can be measured by any of a number of tests known to those skilled in the art. For purposes of this invention, viscosity can be measured with a Carrimed CSL2 Rheometer at a shear rate of 20 $s^{-1}$. Additionally, the melting point can be used to characterize the ethoxylated quaternized amine clay materials of the present invention. A useful standardized test method for measuring the melting point of the amine clay materials of this invention follows ASTM method E 794-95. Specifically, samples are analyzed in duplicate on a TA Instruments 2920 Differential Scanning Calorimeter in hermetic pans with an atmosphere of UHP Nitrogen at a flow rate of 50 mL/min. The samples are cooled down to −40° C. and held there for 5 minutes, then the temperature is ramped up to 100° C. at a scan rate of 10° C./min. This method can be run with an indium calibration check sample.

SURFACTANT-CONTAINING LIQUID PHASE

The surfactant-containing, non-aqueous liquid phase will generally comprise from about 49% to 99.95% by weight of the detergent compositions herein. More preferably, this liquid phase is surfactant-structured and will comprise from about 52% to 98.9% by weight of the compositions. Most preferably, this non-aqueous liquid phase will comprise from about 55% to 70% by weight of the compositions herein. Such a surfactant-containing liquid phase will frequently have a density of from about 0.6 to 1.4 g/cc, more preferably from about 0.9 to 1.3 g/cc. The liquid phase of the detergent compositions herein is preferably formed from one or more non-aqueous organic diluents into which is mixed a surfactant structuring agent which is preferably a specific type of anionic surfactant-containing powder. Insoluble particulate material is also preferably suspended in the surfactant-containing liquid phase of the detergent compositions herein. Such additional particulate material ranges in size from about 0.1 to 1500 microns. This additional particulate material can include peroxygen bleaching agents, bleach activators, organic detergent builders and inorganic alkalinity sources and combinations of these additional particulate material types.

(A) Non-aqueous Organic Diluents

The major component of the liquid phase of the detergent compositions herein comprises one or more non-aqueous organic diluents. The non-aqueous organic diluents used in this invention may be either surface active, i.e., surfactant, liquids or non-aqueous, non-surfactant liquids referred to herein as non-aqueous solvents. The term "solvent" is used herein to connote the non-surfactant, non-aqueous liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The non-aqueous liquid diluent component will generally comprise from about 50% to 100%, more preferably from about 50% to 80%, most preferably from about 55% to 75%, of a structured, surfactant-containing liquid phase. Preferably the liquid phase of the compositions herein, i.e., the non-aqueous liquid diluent component, will comprise both non-aqueous liquid surfactants and non-surfactant non-aqueous solvents.

i) Non-aqueous Surfactant Liquids

Suitable types of non-aqueous surfactant liquids which can be used to form the liquid phase of the compositions herein include the alkoxylated alcohols, ethylene oxide (EO)-propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1(C_mH2_mO)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the non-aqueous liquid phase of the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

If alcohol alkoxylate nonionic surfactant is utilized as part of the non-aqueous liquid phase in the detergent compositions herein, it will preferably be present to the extent of from about 1% to 60% of the composition structured liquid phase. More preferably, the alcohol alkoxylate component will comprise about 5% to 40% of the structured liquid phase. Most preferably, an alcohol alkoxylate component will comprise from about 5% to 35% of the detergent composition structured liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 5% to 25% by weight, of the composition.

Another type of non-aqueous surfactant liquid which may be utilized in this invention are the ethylene oxide (EO)—propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents*, 7th Ed.; Longman Scientific and Technical (1987) at pp. 34–36 and pp. 189–191 and in U.S. Pat. Nos. 2,674,619 and 2,677,700. All of these publications are incorporated herein by reference. These Pluronic type nonionic surfactants are also believed to function as effective suspending agents for the particulate material which is dispersed in the liquid phase of the detergent compositions herein.

Another possible type of non-aqueous surfactant liquid useful in the compositions herein comprises polyhydroxy fatty acid amide surfactants. Materials of this type of nonionic surfactant are those which conform to the formula:

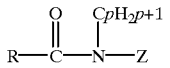

wherein R is a $C_{9-17}$ alkyl or alkenyl, p is from 1 to 6, and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are know and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

The amount of total liquid surfactant in the preferred surfactant-structured, non-aqueous liquid phase herein will be determined by the type and amounts of other composition components and by the desired composition properties. Generally, the liquid surfactant can comprise from about 35% to 70% of the non-aqueous liquid phase of the compositions herein. More preferably, the liquid surfactant will comprise from about 50% to 65% of a non-aqueous structured liquid phase. This corresponds to a non-aqueous liquid surfactant concentration in the total composition of from about 15% to 70% by weight, more preferably from about 20% to 50% by weight, of the composition.

ii) Non-surfactant Non-aqueous Organic Solvents

The liquid phase of the detergent compositions herein may also comprise one or more non-surfactant, non-aqueous organic solvents. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

iii) Blends of Surfactant and Non-surfactant Solvents

In systems which employ both non-aqueous surfactant liquids and non-aqueous non-surfactant solvents, the ratio of surfactant to non-surfactant liquids, e.g., the ratio of alcohol alkoxylate to low polarity solvent, within a structured, surfactant-containing liquid phase can be used to vary the rheological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

(B) Surfactant Structurant

The non-aqueous liquid phase of the detergent compositions of this invention is prepared by combining with the non-aqueous organic liquid diluents hereinbefore described a surfactant which is generally, but not necessarily, selected to add structure to the non-aqueous liquid phase of the detergent compositions herein. Structuring surfactants can be of the anionic, nonionic, cationic, and/or amphoteric types. Organo-modified clays and/or polymers can also be used to structure the non-aqueous detergent compositions of this invention.

Preferred structuring surfactants are the anionic surfactants such as the alkyl sulfates, the alkyl polyalkxylate sulfates and the linear alkyl benzene sulfonates. Another common type of anionic surfactant material which may be optionally added to the detergent compositions herein as structurant comprises carboxylate-type anionics. Carboxylate-type anionics include the $C_{10}$–$C_{18}$ alkyl alkoxy carboxylates (especially the EO 1 to 5 ethoxycarboxylates) and the $C_{10}$–$C_{81}$ sarcosinates, especially oleoyl sarcosinate. Yet another common type of anionic surfactant material which may be employed as a structurant comprises other sulfonated anionic surfactants such as the $C_8$–$C_{18}$ paraffin sulfonates and the $C_8$–$C_{18}$ olefin sulfonates. Structuring anionic surfactants will generally comprise from about 1% to 30% by weight of the compositions herein.

As indicated, one preferred type of structuring anionic surfactant comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10-14}$ alkyl, and M is alkali metal. Most preferably R is about $C_{12}$ and M is sodium.

Conventional secondary alkyl sulfates may also be utilized as a structuring anionic surfactant for the liquid phase of the compositions herein. Conventional secondary alkyl sulfate surfactants are those materials which have the sulfate moiety distributed randomly along the hydrocarbyl "backbone" of the molecule. Such materials may be depicted by the structure:

$$CH_3(CH_2)_n(CHOSO_3^-M^+)\ (CH_2)_mCH_3$$

wherein m and n are integers of 2 or greater and the sum of m+n is typically about 9 to 15, and M is a water-solubilizing cation.

If utilized, alkyl sulfates will generally comprise from about 1% to 30% by weight of the composition, more preferably from about 5% to 25% by weight of the composition. Non-aqueous liquid detergent compositions containing alkyl sulfates, peroxygen bleaching agents, and bleach activators are described in greater detail in Kong-Chan et al.; WO 96/10073; published Apr. 4, 1996, which application is incorporated herein by reference.

Another preferred type of anionic surfactant material which may be optionally added to the non-aqueous cleaning compositions herein as a structurant comprises the alkyl polyalkoxylate sulfates. Alkyl polyalkoxylate sulfates are also known as alkoxylated alkyl sulfates or alkyl ether sulfates. Such materials are those which correspond to the formula $$R^2—O—(C_mH_{2m}O)_n—SO_3M$$

wherein $R^2$ is a $C_{10}$–$C_{22}$ alkyl group, m is from 2 to 4, n is from about 1 to 15, and M is a salt-forming cation. Preferably, $R^2$ is a $C_{12}$–$C_{18}$ alkyl, m is 2, n is from about 1 to 10, and M is sodium, potassium, ammonium, alkylammonium or alkanolammonium. Most preferably, $R^2$ is a $C_{12}$–$C_{16}$, m is 2, n is from about 1 to 6, and M is sodium. Ammonium, alkylammonium and alkanolammonium counterions are preferably avoided when used in the compositions herein because of incompatibility with peroxygen bleaching agents.

If utilized, alkyl polyalkoxylate sulfates can also generally comprise from about 1% to 30% by weight of the composition, more preferably from about 5% to 25% by weight of the composition. Non-aqueous liquid detergent compositions containing alkyl polyalkoxylate sulfates, in combination with polyhydroxy fatty acid amides, are described in greater detail in Boutique et al; PCT Application No. PCT/US96/04223, which application is incorporated herein by reference.

The most preferred type of anionic surfactant for use as a structurant in the compositions herein comprises the linear alkyl benzene sulfonate (LAS) surfactants. In particular, such LAS surfactants can be formulated into a specific type of anionic surfactant-containing powder which is especially useful for incorporation into the non-aqueous liquid detergent compositions of the present invention. Such a powder comprises two distinct phases. One of these phases is insoluble in the non-aqueous organic liquid diluents used in the compositions herein; the other phase is soluble in the non-aqueous organic liquids. It is the insoluble phase of this preferred anionic surfactant-containing powder which can be dispersed in the non-aqueous liquid phase of the preferred compositions herein and which forms a network of aggregated small particles that allows the final product to stably suspend other additional solid particulate materials in the composition.

Such a preferred anionic surfactant-containing powder is formed by co-drying an aqueous slurry which essentially contains a) one of more alkali metal salts of $C_{10-16}$ linear alkyl benzene sulfonic acids; and b) one or more non-surfactant diluent salts. Such a slurry is dried to a solid material, generally in powder form, which comprises both the soluble and insoluble phases.

The linear alkyl benzene sulfonate (LAS) materials used to form the preferred anionic surfactant-containing powder are well known materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11-14}$, e.g., $C_{12}$, LAS is especially preferred. The alkyl benzene surfactant anionic surfactants are generally used in the powder-forming slurry in an amount from about 20 to 70% by weight of the slurry, more preferably from about 20% to 60% by weight of the slurry.

The powder-forming slurry also contains a non-surfactant, organic or inorganic salt component that is co-dried with the LAS to form the two-phase anionic surfactant-containing powder. Such salts can be any of the known sodium, potassium or magnesium halides, sulfates, citrates, carbonates, sulfates, borates, succinates, sulfo-succinates and the like. Sodium sulfate, which is generally a bi-product of LAS production, is the preferred non-surfactant diluent salt for use herein. Salts which function as hydrotropes such as sodium sulfo-succinate may also usefully be included. The non-surfactant salts are generally used in the aqueous slurry, along with the LAS, in amounts ranging from about 1 to 50% by weight of the slurry, more preferably from about 5% to 40% by weight of the slurry. Salts that act as hydrotropes can preferably comprise up to about 3% by weight of the slurry.

The aqueous slurry containing the LAS and diluent salt components hereinbefore described can be dried to form the anionic surfactant-containing powder preferably added to the non-aqueous diluents in order to prepare a structured liquid phase within the compositions herein. Any conventional drying technique, e.g., spray drying, drum drying, etc., or combination of drying techniques, may be employed. Drying should take place until the residual water content of the solid material which forms is within the range of from about 0.5% to 4% by weight, more preferably from about 1% to 3% by weight.

The anionic surfactant-containing powder produced by the drying operation constitutes two distinct phases, one of which is soluble in the inorganic liquid diluents used herein and one of which is insoluble in the diluents. The insoluble phase in the anionic surfactant-containing powder generally comprises from about 10% to 45% by weight of the powder, more preferably from about 15% to 35% by weight of a powder.

The anionic surfactant-containing powder that results after drying can comprise from about 45% to 94%, more preferably from about 60% to 94%, by weight of the powder of alkyl benzene sulfonic acid salts. Such concentrations are generally sufficient to provide from about 0.5% to 60%, more preferably from about 15% to 60%, by weight of the total detergent composition that is eventually prepared, of the alkyl benzene sulfonic acid salts. The anionic surfactant-containing powder itself can comprise from about 0.45% to 45% by weight of the total composition that is eventually prepared. After drying, the anionic surfactant-containing powder will also generally contain from about 2% to 50%, more preferably from about 2% to 25% by weight of the powder of the non-surfactant salts.

After it is dried to the requisite extent, the combined LAS/salt material can be converted to flakes or powder form by any known suitable milling or comminution process. Generally at the time such material is combined with the non-aqueous organic solvents to form the structured liquid phase of the compositions herein, the particle size of this powder will range from 0.1 to 2000 microns, more preferably from about 0.1 to 1000 microns.

A structured, surfactant-containing liquid phase of the preferred detergent compositions herein can be prepared by combining the non-aqueous organic diluents hereinbefore described with the anionic surfactant-containing powder as hereinbefore described. Such combination results in the formation of a structured surfactant-containing liquid phase. Conditions for making this combination of preferred structured liquid phase components are described more fully hereinafter in the "Composition Preparation and Use" section. As previously noted, the formation of a structured, surfactant-containing liquid phase permits the stable suspension of colored speckles and additional functional particulate solid materials within the preferred detergent compositions of this invention.

Additional suitable surfactants for use in the present invention included nonionic surfactants, specifically, polyhydroxy fatty acid amides of the formula:

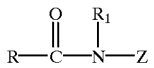

wherein R is a $C_{9-17}$ alkyl or alkenyl, $R_1$ is a methyl group and Z is glycityl derived from a reduced sugar or alkoxylated derivative thereof Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Preferred surfactants for use in the detergent compositions described herein are amine based surfactants of the general formula:

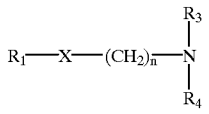

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2$—$CH_2$—$O(R_5)$) wherein $R_5$ is H or methyl. Especially preferred amines based surfactants include the following:

$R_1$—$(CH_2)_2$—$NH_2$ $R_1$—O—$(CH_2)_3$—$NH_2$ $R_1$—C(O)—NH—$(CH_2)_3$—$N(CH_3)_2$

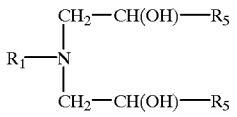

wherein $R_1$ is a $C_6$–$C_{12}$ alkyl group and $R_5$ is H or $CH_3$. Particularly preferred amines for use in the surfactants defined above include those selected from the group consisting of octyl amine, hexyl amine, decyl amine, dodecyl amine, $C_8$–$C_2$ bis(hydroxyethyl)amine, $C_8$–$C_{12}$ bis (hydroxyisopropyl)amine, $C_8$–$C_{12}$ amido-propyl dimethyl amine, or mixtures thereof.

In a highly preferred embodiment, the amine based surfactant is described by the formula:

$R_1$—C(O)—NH—$(CH_2)_3$—$N(CH_3)_2$ wherein $R_1$ is $C_8$–$C_{12}$ alkyl.

SOLID PARTICULATE MATERIALS

In addition to the surfactant-containing liquid phase and the colored speckles, the non-aqueous detergent compositions herein also preferably comprise from about 1% to 50% by weight, more preferably from about 29% to 44% by weight, of additional solid phase particulate material which is dispersed and suspended within the liquid phase. Generally such particulate material will range in size from about 0.1 to 1500 microns, more preferably from about 0.1 to 900 microns. Most preferably, such material will range in size from about 5 to 200 microns.

The additional particulate material utilized herein can comprise one or more types of detergent composition components which in particulate form are substantially insoluble in the non-aqueous liquid phase of the composition. The types of particulate materials which can be utilized are described in detail as follows:

(A) Peroxygen Bleaching Agent With Optional Bleach Activators

The most preferred type of particulate material useful in the detergent compositions herein comprises particles of a peroxygen bleaching agent. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used in particulate form in the detergent compositions herein. Inorganic bleaching agents are in fact preferred. Such inorganic peroxygen compounds include alkali metal perborate and percarbonate materials, most preferably the percarbonates. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical. Mixtures thereof can also be used. See also the hereinbefore referenced U.S. Pat. No. 4,634,551 for other typical bleaches and activators useful herein.

Other useful amido-derived bleach activators are those of the formulae:

$R^1N(R^5)C(O)R^2C(O)L$ or $R^1C(O)N(R^5)R^2C(O)L$ wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanarnidocaproyl) oxybenzenesulfonate, (6-decanamido-caproyl) oxybenzenesulfonate and mixtures thereof as described in the hereinbefore referenced U.S. Pat. No. 4,634,551. Such mixtures are characterized herein as (6-$C_8$–$C_{10}$ alkamido-caproyl)oxybenzenesulfonate.

Another class of useful bleach activators comprises the benzoxazin-type activators disclosed by Hodge et al. in U.S. Pat. No. 4,966,723, Issued Oct. 30, 1990, incorporated herein by reference. A highly preferred activator of the benzoxazin-type is:

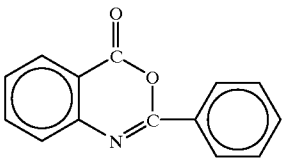

Still another class of useful bleach activators includes the acyl lactam activators, especially acyl caprolactams and acyl valerolactams of the formulae:

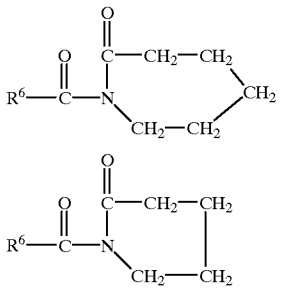

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, 3,5,5-trimethylhexanoyl valerolactam and mixtures thereof See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If peroxygen bleaching agents are used as all or part of the additional particulate material, they will generally comprise from about 1% to 30% by weight of the composition. More preferably, peroxygen bleaching agent will comprise from about 1% to 20% by weight of the composition. Most preferably, peroxygen bleaching agent will be present to the extent of from about 5% to 20% by weight of the composition. If utilized, bleach activators can comprise from about 0.5% to 20%, more preferably from about 3% to 10%, by weight of the composition. Frequently, activators are employed such that the molar ratio of bleaching agent to activator ranges from about 1:1 to 10:1, more preferably from about 1.5:1 to 5:1. In addition, it has been found that bleach activators, when agglomerated with certain acids such as citric acid, are more chemically stable.

(B) Organic Builder Material

Another possible type of additional particulate material which can be suspended in the non-aqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark which have molecular weight ranging from about 5,000 to 100,000.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the additional particulate material, insoluble organic detergent builders can generally comprise from about 2% to 20% by weight of the compositions herein. More preferably, such builder material can comprise from about 4% to 10% by weight of the composition.

(C) Inorganic Alkalinity Sources

Another possible type of additional particulate material which can be suspended in the non-aqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the non-aqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the additional particulate material component, the alkalinity source will generally comprise from about 1% to 25% by weight of the compositions herein. More preferably, the alkalinity source can comprise from about 2% to 15% by weight of the composition. Such materials, while water-soluble, will generally be insoluble in the non-aqueous detergent compositions herein. Thus such materials will generally be dispersed in the non-aqueous liquid phase in the form of discrete particles.

(D) Colored Speckles

The non-aqueous liquid detergent compositions herein also essentially contain from about 0.05% to 2%, more preferably 0.1% to 1%, of the composition of colored speckles. Such colored speckles themselves are combinations of a conventional dye or pigment material with a certain kind of carrier material that imparts specific characteristics to the speckles. For purposes of this invention, "colored" speckles are those which have a color that is visibly distinct from the color of the liquid detergent composition in which they are dispersed.

The colorant materials which can be used to form the colored speckles can comprise any of the conventional dyes and pigments known and approved for use in detergent products for use in the home. Such materials can include, for example, Ultramarine Blue dye, Acid 80 Blue dye, Red HP Liquitint, Blue Liquitint and the like.

Dye or pigment material can be combined with a specific type of carrier material to form the colored speckles for use in the detergent compositions herein. The carrier material is selected to impart to the speckles certain specific density and solubility characteristics. Materials which have been found to be suitable as carriers for the colored speckles include polyacrylates; polysaccharides such as starches, celluloses, gums and derivatives thereof, and polyethylene glycols. Especially preferred carrier material comprises polyethylene glycol having a molecular weight from about 4,000 to 20,000, more preferably from about 4,000 to 10,000.

The colored speckles can be produced by dispersing the dye or pigment material within the carrier material. This can be done, for example, by a) melting the carrier and dispersing the dye or pigment therein under mixing, b) mixing the dye/pigment powder and carrier powder together, or c) by dissolving the dye/pigment and the carrier in aqueous solution. The colorant/carrier mixture can then be formed into particles by flaking, spray drying, prilling, extruding or other conventional techniques. Generally the colored speckles will contain from about 0.1% to 5% by weight of the speckles of the colorant (dye or pigment) material.

The colored speckles produced in this manner will generally range in size from about 400 to 1,500 microns, more preferably from about 400 to 1,200 microns. Speckles made from the carrier materials specified will have a density less than about 1.4 g/cc, preferably from about 1.0 to 1.4 g/cc. Such speckles will also be substantially insoluble in the non-aqueous liquid phase of the liquid detergent compositions herein. Thus, the colored speckles can be stably suspended in the non-aqueous matrix of the liquid detergent compositions of this invention without dissolving therein. Such speckles, however, rapidly dissolve in the aqueous wash liquors prepared from the liquid detergent compositions herein.

OTHER OPTIONAL COMPOSITION COMPONENTS

In addition to the composition liquid and solid phase components as hereinbefore described, the detergent compositions herein can, and preferably will, contain various other optional components. Such optional components may be in either liquid or solid form. The optional components may either dissolve in the liquid phase or may be dispersed within the liquid phase in the form of fine particles or droplets. Some of the other materials which may optionally be utilized in the compositions herein are described in greater detail as follows:

(a) Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

(b) Optional Enzymes

The detergent compositions herein may also optionally contain one or more types of detergent enzymes. Such enzymes can include proteases, amylases, cellulases and lipases. Such materials are known in the art and are commercially available. They may be incorporated into the non-aqueous liquid detergent compositions herein in the form of suspensions, "marumes" or "prills". Another suitable type of enzyme comprises those in the form of slurries of enzymes in nonionic surfactants, e.g., the enzymes marketed by Novo Nordisk under the tradename "SL" or the microencapsulated enzymes marketed by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the non-aqueous liquid compositions herein at levels sufficient to provide up to about 10 mg by weight, more typically from about 0.01 mg to about 5 mg, of active enzyme per gram of the composition. Stated otherwise, the non-aqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

Protease and/or Other Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof A preferred combination is a detergent composition having a cocktail of conventional applicable enzymes like protease, amylase, lipase, cutinase and/or cellulase.

The compositions of this invention can also optionally contain from about 0.0001% to about 5%, more preferably from about 0.003% to about 4%, most preferably from about 0.005% to about 3%, by weight, of active protease, i.e., proteolytic, enzyme. Protease activity may be expressed in Anson units (AU.) per kilogram of detergent composition. Levels of from 0.01 to about 150, preferably from about 0.05 to about 80, most preferably from about 0.1 to about 40 AU. per kilogram have been found to be acceptable in compositions of the present invention.

Useful proteolytic enzymes can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis.*

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent EP-B-251,446, granted Dec. 28, 1994 and published Jan. 7, 1988 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Preferred proteolytic enzymes, then, are selected from the group consisting of Alcalase® (Novo Industri A/S), BPN', Protease A and Protease B (Genencor), and mixtures thereof Protease B is most preferred.

Of particular interest for use herein are the proteases described in U.S. Pat. No. 5,470,733. Also proteases described in our co-pending application U.S. Ser. No. 08/136,797 U.S. Pat. No. 5,679,630 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position+76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Other optional enzymes such as lipase and/or amylase may be also added to the compositions of the present invention for additional cleaning benefits.

Cellulases

The cellulases usable in the present invention include both bacterial or fungal cellulase. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (Humicola grisea var. thermoidea), particularly the Humicola, strain DSM 1800. Other suitable cellulases are cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Mannanase

A preferred element of the detergent compositions of the present invention is a mannanase enzyme. Encompassed in the present invention are the following three mannans-degrading enzymes: EC 3.2.1.25: β-mannosidase, EC 3.2.1.78 : Endo-1,4-βmannosidase, referred therein after as "mannanase" and EC 3.2.1.100: 1,4-β-mannobiosidase (IUPAC Classification-Enzyme nomenclature, 1992 ISBN 0-12-227165-3 Academic Press).

More preferably, the detergent compositions of the present invention comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D- mannosidic linkages in mannans, galactomannans, glucomannans, and galactoglucomannans.

In particular, Mannanases (EC 3.2.1.78) constitute a group of polysaccharases which degrade mannans and denote enzymes which are capable of cleaving polyose chains contaning mannose units, i.e. are capable of cleaving glycosidic bonds in mannans, glucomannans, galactomannans and galactoglucomannans. Mannans are polysaccharides having a backbone composed of β-1,4- linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The degradation of galactomannans and galactoglucomannans is facilitated by full or partial removal of the galactose sidebranches. Further the degradation of the acetylated mannans, glucomannans, galactomannans and galactogluco-mannans is facilitated by full or partial deacetylation. Acetyl groups can be removed by alkali or by mannan acetylesterases. The oligomers which are released from the mannanases or by a combination of mannanases and α-galactosidase and/or mannan acetyl esterases can be further degraded to release free maltose by β-mannosidase and/or β-glucosidase.

Mannanases have been identified in several Bacillus organisms. For example, Talbot et al., Appl. Environ. Microbiol., Vol.56, No. 11, pp. 3505–3510 (1990) describes a beta-mannanase derived from *Bacillus stearothermophilus* in dimer form having molecular weight of 162 kDa and an optimum pH of 5.5–7.5. Mendoza et al., World J. Microbiol. Biotech., Vol. 10, No. 5, pp. 551–555 (1994) describes a beta-mannanase derived from *Bacillus subtilis* having a molecular weight of 38 kDa, an optimum activity at pH 5.0 and 55C and a pI of 4.8. JP-03047076 discloses a beta-mannanase derived from Bacillus sp., having a molecular wgt. of 373 kDa measured by gel filtration, an optimum pH of 8–10 and a pI of 5.3–5.4. JP-63056289 describes the production of an alkaline, thermostable beta-mannanase which hydrolyses beta-1,4-D-mannopyranoside bonds of e.g. mannans and produces manno-oligosaccharides. JP-63036774 relates to the Bacillus microorganism FERM P-8856 which produces beta-mannanase and beta-mannosidase at an alkaline pH. JP-08051975 discloses alkaline beta-mannanases from alkalophilic Bacillus sp. AM-001. A purified mannanase from *Bacillus amyloliquefaciens* useful in the bleaching of pulp and paper and a method of preparation thereof is disclosed in WO 97/11164. WO 91/18974 describes a hemicellulase such as a glucanase, xylanase or mannanase active at an extreme pH and temperature. WO 94/25576 discloses an enzyme from *Aspergillus aculeatus*, CBS 101.43, exhibiting mannanase activity which may be useful for degradation or modification of plant or algae cell wall material. WO 93/24622 discloses a mannanase isolated from *Trichoderma reseei* useful for bleaching lignocellulosic pulps. An hemicellulase capable of degrading mannan-containing hemicellulose is described in WO91/18974 and a purified mannanase from *Bacillus amyloliquefaciens* is described in WO97/11164.

Preferably, the mannanase enzyme will be an alkaline mannanase as defined below, more preferably, a mannanase originating from a bacterial source. Especially, the laundry detergent composition of the present invention will comprise an alkaline mannanase selected from the mannanase from the strain *Bacillus agaradhaerens* NICMB 40482; the mannanase from *Bacillus subtilis* strain 168, gene yght; the mannanase from Bacillus sp. I633 and/or the mannanase from Bacillus sp. AAI 12. Most preferred mannanase for the inclusion in the detergent compositions of the present invention is the mannanase enzyme originating from Bacillus sp. I633 as described in the co-pending Danish application No. PA 1998 01340.

The terms "alline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

The alkaline mannanase from *Bacillus agaradhaerens* NICMB 40482 is described in the co-pending U.S. patent application Ser. No. 09/111,256. More specifically, this mannanase is:

i) a polypeptide produced by *Bacillus agaradhaerens*, NCIMB 40482; or ii) a polypeptide comprising an amino acid sequence as shown in positions 32–343 of SEQ ID NO:2 as shown in U.S. patent application Ser. No. 09/111,256; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of:

(a) polynucleotide molecules encoding a polypeptide having mannanase activity and comprising a sequence of nucleotides as shown in SEQ ID NO: 1 from nucleotide 97 to nucleotide 1029 as shown in U.S. patent application Ser. No. 09/111,256;

(b) species homologs of (a);

(c) polynucleotide molecules that encode a polypeptide having mannanase activity that is at least 70% identical to the amino acid sequence of SEQ ID NO: 2 from amino acid residue 32 to amino acid residue 343 as shown in U.S. patent application Ser. No. 09/111,256;

(d) molecules complementary to (a), (b) or (c); and (e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 18, 1998 under the deposition number DSM 12180.

A second more preferred enzyme is the mannanase from the *Bacillus subtilis* strain 168, which is described in the co-pending U.S. patent application Ser. No. 09/095,163. More specifically, this mannanase is:

i) is encoded by the coding part of the DNA sequence shown in SED ID No. 5 shown in the U.S. patent application Ser. No. 09/095,163 or an analogue of said sequence; and/or ii) a polypeptide comprising an amino acid sequence as shown SEQ ID NO:6 shown in the U.S. patent application Ser. No. 09/095,163; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

(a) polynucleotide molecules encoding a polypeptide having mannanase activity and comprising a sequence of nucleotides as shown in SEQ ID NO:5 as shown in the U.S. patent application Ser. No. 09/095,163

(b) species homologs of (a);

(c) polynucleotide molecules that encode a polypeptide having mannanase activity that is at least 70% identical to the amino acid sequence of SEQ ID NO: 6 as shown in the U.S. patent application Ser. No. 09/095,163;

(d) molecules complementary to (a), (b) or (c); and (e) degenerate nucleotide sequences of (a), (b), (c) or (d).

A third more preferred mannanase is described in the co-pending Danish patent application No. PA 1998 01340. More specifically, this mannanase is:

i) a polypeptide produced by Bacillus sp. I633;

ii) a polypeptide comprising an amino acid sequence as shown in positions 33–340 of SEQ ID NO:2 as shown in the Danish application No. PA 1998 01340; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

(a) polynucleotide molecules encoding a polypeptide having mannanase activity and comprising a sequence of nucleotides as shown in SEQ ID NO: 1 from nucleotide 317 to nucleotide 1243 the Danish application No. PA 1998 01340;

(b) species homologs of (a);

(c) polynucleotide molecules that encode a polypeptide having mannanase activity that is at least 65% identical to the amino acid sequence of SEQ ID NO: 2 from amino acid residue 33 to amino acid residue 340 the Danish application No. PA 1998 01340;

(d) molecules complementary to (a), (b) or (c); and (e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on May 29, 1998 under the deposition number DSM 12197.

A fourth more preferred mannanase is described in the Danish co-pending patent application No. PA 1998 01341. More specifically, this mannanase is:

i) a polypeptide produced by Bacillus sp. AAI 12;

ii) a polypeptide comprising an amino acid sequence as shown in positions 25–362 of SEQ ID NO:2 as shown in the Danish application No. PA 1998 01341; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of (a) polynucleotide molecules encoding a polypeptide having mannanase activity and comprising a sequence of nucleotides as shown in SEQ ID NO: 1 from nucleotide 225 to nucleotide 1236 as shown in the Danish application No. PA 1998 01341;

(b) species homologs of (a);

(c) polynucleotide molecules that encode a polypeptide having mannanase activity that is at least 65% identical to the amino acid sequence of SEQ ID NO: 2 from amino acid residue 25 to amino acid residue 362 as shown in the Danish application No. PA 1998 01341;

(d) molecules complementary to (a), (b) or (c); and (e) degenerate nucleotide sequences of (a), (b), (c) or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on Oct. 7, 1998 under the deposition number DSM 12433.

Lipase

Suitable lipase enzymes include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereinafter referred to as "Amano-P". Further suitable lipases are lipases such as M1 Lipase® and Lipomax® (Gist-Brocades). Other suitable commercial lipases include Amano-CES, lipases ex *Chromobacter viscosum*, e.g. *Chromobacter viscosum var. lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Highly preferred lipases are the D96L lipolytic enzyme variant of the native lipase derived from *Humicola lanuginosa* as described in U.S. Ser. No. 08/341,826. (See also patent application WO 92/05249 viz. wherein the native lipase ex Humicola lanuginosa aspartic acid (D) residue at position 96 is changed to Leucine (L). According to this nomenclature said substitution of aspartic acid to Leucine in position 96 is shown as : D96L.) Preferably the *Humicola lanuginosa* strain DSM 4106 is used.

In spite of the large number of publications on lipase enzymes, only the lipase derived from *Humicola lanuginosa* and produced in *Aspergillus oryzae* as host has so far found widespread application as additive for washing products. It is available from Novo Nordisk under the tradename Lipolase® and Lipolase Ultra®, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500,000 LU/liter) lipase variant per liter of wash liquor.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

The lipases and/or cutinases are normally incorporated in the detergent composition at levels from 0.0001% to 2% of active enzyme by weight of the detergent composition.

Amylase

Amylases (α and/or β) can be included for removal of carbohydrate-based stains. Suitable amylases are Termamyl® (Novo Nordisk), Fungamyl® and BAN® (Novo Nordisk). The enzymes may be of any suitable origin, such as vegetable, animal, bacterial, fungal and yeast origin. Amylase enzymes are normally incorporated in the detergent composition at levels from 0.0001% to 2% of active enzyme by weight of the detergent composition.

Amylase enzymes also include those described in WO95/26397 and in co-pending application by Novo Nordisk PCT/DK96/00056. Other specific amylase enzymes for use in the detergent compositions of the present invention therefore include:

(a) α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference. or an α-amylase being at least 80% homologous with the amino acid sequence shown in the SEQ ID listing.

(c) α-amylases according (a) comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%

(d) α-amylases according (a–c) wherein the α-amylase is obtainable from an alkalophilic Bacillus species; and in particular, from any of the strains NCIB 12289, NCIB 12512, NCIB 12513 and DSM 935. In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e) α-amylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those α-amylases in (a–e), or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase; the variant having an α-amylase activity and exhibiting at least one of the following properties relative to said parent α-amylase : increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium.

The variants are described in the patent application PCT/DK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens; B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

(c) Optional Chelating Agents

The detergent compositions herein may also optionally contain a chelating agent which serves to chelate metal ions, e.g., iron and/or manganese, within the non-aqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from- about 0.2% to 2% by weight of the detergent compositions herein.

(d) Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) or polyamide resins.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 100,000, more preferably from about 2,000 to 10,000, even more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

(e) Optional Clay Soil Removal/Anti-redeposition Agents

The compositions of the present invention can also optionally contain water-soluble ethoxylated amines having clay soil removal and anti-redeposition properties. If used, soil materials can contain from about 0.01% to about 5% by weight of the compositions herein.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-anti-redeposition agents are the cationic compounds disclosed in European Patent Application 111,965, Oh and Gosselink, published Jun. 27, 1984. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti-redeposition agents known in the art can also be utilized in the compositions herein. Another type of preferred anti-redeposition agent includes the carboxy methyl cellulose (CMC) materials. These materials are well known in the art.

(f) Optional Liquid Bleach Activators

The detergent compositions herein may also optionally contain bleach activators which are liquid in form at room temperature and which can be added as liquids to the non-aqueous liquid phase of the detergent compositions herein. One such liquid bleach activator is acetyl triethyl citrate (ATC). Other examples include glycerol triacetate and nonanoyl valerolactam. Liquid bleach activators can be dissolved in the non-aqueous liquid phase of the compositions herein.

(g) Optional Bleach Catalysts

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3(1,4,7\text{-trimethyl-}1,4,7\text{-triazacyclononane})_2\text{-}(PF_6)2$, $Mn^{III}{}_2(u\text{-}O)_1(u\text{-}OAc)_2(1,4,7\text{-trimethyl- }1,4,7\text{-triazacyclononane})_2(ClO_4)_2$, $Mn^{IV}{}_4(u\text{-}O)_6(1,4,7\text{-triazacyclononane})_4(ClO_4)_4$, $Mn^{III}Mn^{IV}{}_4(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl- }1,4,7\text{-tri-azacyclononane})\text{- }(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Cobalt bleach catalysts useful herein are known, and are described, for example, in M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]$ Ty, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in the Tobe article and the references cited therein, in U.S. Pat. No. 4,810,410, to Diakun et al, issued Mar. 7,1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.*, 18, 1497–1502 (1979); *Inorg. Chem.*, 21, 2881–2885 (1982); *Inorg. Chem.*, 18, 2023–2025 (1979); Inorg. Synthesis, 173–176 (1960); and *Journal of Physical Chemistr*, 56, 22–25 (1952).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

(h) Optional Brighteners, Suds Suppressors, Dyes and/or Perfumes

The detergent compositions herein may also optionally contain conventional brighteners, suds suppressors, bleach catalysts, dyes and/or perfume materials. Such brighteners, suds suppressors, silicone oils, bleach catalysts, dyes and perfumes must, of course, be compatible and non-reactive with the other composition components in a non-aqueous environment. If present, brighteners suds suppressors, dyes and/or perfumes will typically comprise from about 0.0001% to 2% by weight of the compositions herein. Suitable bleach catalysts include the manganese based complexes disclosed in U.S. Pat. No. 5,246,621, U.S. Pat. No. 5,244,594, U.S. Pat. No. 5,114,606 and U.S. Pat. No. 5,114,611.

(i) Structure Elasticizing Agents

The non-aqueous liquid detergent compositions herein can also contain from about 0.1% to 5%, preferably from about 0.1% to 2% by weight of a finely divided, solid particulate material which can include silica, e.g., fumed silica, titanium dioxide, insoluble carbonates, finely divided carbon or combinations of these materials. Fine particulate material of this type functions as a structure elasticizing agent in the products of this invention. Such material has an average particle size ranging from about 7 to 40 nanometers, more preferably from about 7 to 15 nanometers. Such material also has a specific surface area which ranges from about 40 to 400 $m^2/g$.

The finely divided elasticizing agent material can improve the shipping stability of the non-aqueous liquid detergent products herein by increasing the elasticity of the surfactant-structured liquid phase without increasing product viscosity. This permits such products to withstand high frequency vibration which may be encountered during shipping without undergoing undersirable structure breakdown which could lead to sedimentation in the product.

In the case of titanium dioxide, the use of this material also imparts whiteness to the suspension of particulate material within the detergent compositions herein. This effect improves the overall appearance of the product.

COMPOSITION FORM

As indicated, the non-aqueous liquid detergent compositions herein are in the form of bleaching agent and/or other materials in particulate form as a solid phase suspended in and dispersed throughout a surfactant-containing, preferably structured non-aqueous liquid phase. Generally, the structured non-aqueous liquid phase will comprise from about 45% to 95%, more preferably from about 50% to 90%, by weight of the composition with the dispersed additional solid materials comprising from about 5% to 55%, more preferably from about 10% to 50%, by weight of the composition.

The particulate-containing liquid detergent compositions of this invention are substantially non-aqueous (or anhydrous) in character. While very small amounts of water may be incorporated into such compositions as an impurity in the essential or optional components, the amount of water should in no event exceed about 5% by weight of the compositions herein. More preferably, water content of the non-aqueous detergent compositions herein will comprise less than about 1% by weight.

COMPOSITION PREPARATION AND USE

The non-aqueous liquid detergent compositions herein can be prepared by first forming the surfactant-containing, preferably structured non-aqueous liquid phase and by thereafter adding to this structured phase the additional particulate components in any convenient order and by mixing, e.g., agitating, the resulting component combination to form the phase stable compositions herein. In a typical process for preparing such compositions, essential and certain preferred optional components will be combined in a particular order and under certain conditions. The ethoxylated quaternized amine clay materials of the present invention can be added during any of the processing steps defined below.

In a first step of a preferred preparation process, the anionic surfactant-containing powder used to form the structured, surfactant-containing liquid phase is prepared. This pre-preparation step involves the formation of an aqueous slurry containing from about 30% to 60% of one or more alkali metal salts of linear $C_{10-16}$ alkyl benzene sulfonic acid and from about 2% to 30% of one or more diluent non-surfactant salts. In a subsequent step, this slurry is dried to the extent necessary to form a solid material containing less than about 4% by weight of residual water.

After preparation of this solid anionic surfactant-containing material, this material can be combined with one or more of the non-aqueous organic diluents to form a structured, surfactant-containing liquid phase of the detergent compositions herein. This is done by reducing the anionic surfactant-containing material formed in the previously described pre-preparation step to powdered form and by combining such powdered material with an agitated liquid medium comprising one or more of the non-aqueous organic diluents, either surfactant or non-surfactant or both, as hereinbefore described. This combination is carried out under agitation conditions which are sufficient to form a thoroughly mixed dispersion of particles of the insoluble fraction of the co-dried LAS/salt material throughout a non-aqueous organic liquid diluent.

In a subsequent processing step, the non-aqueous liquid dispersion so prepared can then be subjected to milling or high shear agitation under conditions which are sufficient to provide a structured, surfactant-containing liquid phase of the detergent compositions herein. Such milling or high shear agitation conditions will generally include maintenance of a temperature between about 10° C. and 90° C., preferably between about 20° C. and 60° C.; and a processing time that is sufficient to form a network of aggregated small particles of the insoluble fraction of the anionic surfactant-containing powdered material. Suitable equipment for this purpose includes: stirred ball mills, co-ball mills (Fryma), colloid mills, high pressure homogenizers, high shear mixers, and the like. The colloid mill and high shear mixers are preferred for their high throughput and low capital and maintenance costs. The small particles produced in such equipment will generally range in size from about 0.4 to 2 microns. Milling and high shear agitation of the liquid/solids combination will generally provide an increase in the yield value of the structured liquid phase to within the range of from about 1 Pa to 8 Pa, more preferably from about 1 Pa to 4 Pa.

After formation of the dispersion of LAS/salt co-dried material in the non-aqueous liquid, either before or after such dispersion is milled or agitated to increase its yield value, the additional particulate material to be used in the detergent compositions herein can be added. Such components which can be added under high shear agitation include a silica or titanium dioxide elasticizing agent; particles of substantially all of an organic builder, e.g., citrate and/or fatty acid, and/or an alkalinity source, e.g., sodium carbonate, can be added while continuing to maintain this admixture of composition components under shear agitation. Agitation of the mixture is continued, and if necessary, can be increased at this point to form a uniform dispersion of insoluble solid phase particulates within the liquid phase.

After some or all of the foregoing solid materials have been added to this agitated mixture, the particles and the highly preferred peroxygen bleaching agent can be added to the composition, again while the mixture is maintained under shear agitation. By adding the peroxygen bleaching agent material last, or after all or most of the other components, and especially after alkalinity source particles, have been added, desirable stability benefits for the peroxygen bleach can be realized. If enzyme prills are incorporated, they are preferably added to the non-aqueous liquid matrix last.

As a final process step, after addition of all of the particulate material, agitation of the mixture is continued for a period of time sufficient to form compositions having the requisite viscosity, yield value and phase stability characteristics. Frequently this will involve agitation for a period of from about 1 to 30 minutes.

In adding solid components to non-aqueous liquids in accordance with the foregoing procedure, it is advantageous to maintain the free, unbound moisture content of these solid materials below certain limits. Free moisture in such solid materials is frequently present at levels of 0.8% or greater. By reducing free moisture content, e.g., by fluid bed drying, of solid particulate materials to a free moisture level of 1.0% or lower prior to their incorporation into the detergent composition matrix, significant stability advantages for the resulting composition can be realized.

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 800 to 3,000 ppm of the detergent compositions herein will be provided in aqueous washing/bleaching solution.

The following examples illustrate the preparation and performance advantages of the speckle-containing non-aqueous liquid detergent compositions of the instant invention. Such examples, however, are not necessarily meant to limit or otherwise define the scope of the invention herein.

EXAMPLE I

Preparation of LAS Powder for Use as a Structurant

Sodium $C_{12}$ linear alkyl benzene sulfonate (NALAS) is processed into a powder containing two phases. One of these phases is soluble in the non-aqueous liquid detergent compositions herein and the other phase is insoluble. It is the insoluble fraction which serves to add structure and particle suspending capability to the non-aqueous phase of the compositions herein.

NaLAS powder is produced by taking a slurry of NaLAS in water (approximately 40–50% active) combined with dissolved sodium sulfate (3–15%) and hydrotrope, sodium sulfosuccinate (1–3%). The hydrotrope and sulfate are used to improve the characteristics of the dry powder. A drum dryer is used to dry the slurry into a flake. When the NaLAS is dried with the sodium sulfate, two distinct phases are created within the flake. The insoluble phase creates a network structure of aggregate small particles (0.4–2 um) which allows the finished non-aqueous detergent product to stably suspend solids.

The NaLAS powder prepared according to this example has the following makeup shown in Table I.

TABLE I

LAS Powder

| Component | Wt % |
|---|---|
| NaLAS | 85% |
| Sulfate | 11% |
| Sulfosuccinate | 2% |
| Water | 2.5% |
| Unreacted, etc. | balance to 100% |
| % insoluble LAS | 17% |
| # of phase (via X-ray diffraction) | 2 |

EXAMPLE II

Preparation of Non-Aqueous Liquid Detergent Composition

1) Butoxy-propoxy-propanol (BPP) and a $C_{11-15}EO(5)$ ethoxylated alcohol nonionic surfactant (Neodol 1-5) are mixed for a short time (1–2 minutes) using a pitched blade turbine impeller in a mix tank into a single phase.

2) NaLAS powder as prepared in Example II is added to the BPP/Neodol solution in the mix tank to partially dissolve the NaLAS. Mix time is approximately one hour. The tank is blanketed with nitrogen to prevent moisture pickup from the air. The soluble phase of NaLAS powder dissolves, while the insoluble NaLAS aggregates and forms a network structure within the BPP/Neodol solution.

3) Liquid base (LAS/BPP/NI) is pumped out into drums. Molecular sieves (type 3A, 4–8 mesh) are added to each drum at 10% of the net weight of the liquid base. The molecular sieves are mixed into the liquid base using both single blade turbine mixers and drum rolling techniques. The mixing is done under nitrogen blanket to prevent moisture pickup from the air. Total mix time is 2 hours, after which 0.1–0.4% of the moisture in the liquid base is removed.

4) Molecular sieves are removed by passing the liquid base through a 20–30 mesh screen. Liquid base is returned to the mix tank.

5) Additional solid ingredients are prepared for addition to the composition. Such solid ingredients include the following:

Sodium carbonate (particle size 10–40 microns)

Sodium citrate dihydrate

Maleic-acrylic copolymer (BASF's Sokalan CP5; moisture content 4.1–5.0%)

Brightener

Titanium dioxide particles (1–5 microns)

Trisodium ethylene diamine disuccinate (EDDS)

These solid materials, which are all millable, are added to the mix tank through a 20–30 mesh screen and mixed with the liquid base until smooth. This approximately 1 hour after addition of the last powder. The tank is blanketed with nitrogen after addition of the powders. No particular order of addition for these powders is critical.

6) The batch is pumped once through a Fryma colloid mill, which is a simple rotor-stator configuration in which a high-speed rotor spins inside a stator which creates a zone of high shear. This serves to disperse the insoluble NaLAS aggregates and partially reduce the particle size of all of the solids. This leads to an increase in yield value (i.e. structure). The batch is then recharged to the mix tank.

7) Still additional solid materials which should not be milled or subjected to high shear agitation are then prepared. These include the following:

Colored speckles

Sodium 6-($C_{8-10}$ alkamidocaproyl) oxybenzene sulfonate bleach activator

Sodium perborate (20–40 microns)

Cellulase and amylase enzyme prills (100–1000 microns)

Thickener

Ethoxylated hexamethylenediamine quat

These non-millable solid materials are then added to the mix tank followed by liquid ingredients (perfume and silicone-based suds suppressor). The batch is then mixed for one hour (under nitrogen blanket). The resulting composition has the formula set forth in Table II.

TABLE II

Non-Aqueous Liquid Detergent Composition with Bleach

| Component | Wt % Active |
|---|---|
| LAS | 16 |
| $C_{11}E0$ = 5 alcohol ethoxylate | 22 |
| BPP | 19 |
| Sodium citrate dihydrate | 3 |
| Bleach activator | 5.9 |
| Sodium carbonate | 9 |
| Maleic-acrylic copolymer | 3 |
| Colored speckles | 0.4 |
| EDDS | 1 |
| Cellulase Prills | 0.12 |
| Amylase Prills | 0.4 |
| Ethoxylated quaternized amine clay material | 2 |
| Sodium Perborate | 15 |
| Thickener | 0.4 |
| Suds suppressor | 0.04 |
| Perfume | 0.48 |
| Titanium dioxide | 0.5 |
| Brightener | 0.2 |
| | 100.00% |

The resulting Table II composition is a stable, anhydrous heavy-duty liquid laundry detergent which provides excellent stain and soil removal performance when used in normal fabric laundering operations. It has aesthetically pleasing blue speckles suspended throughout a generally white opaque liquid composition.

EXAMPLE III

Preparation of PEI 600 E7

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 250 g portion of polyethyleneimine (PEI) (Nippon Shokubai, having a listed average molecular weight of 600 equating to about 0.417 moles of polymer and 6.25 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 275 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 135 g of a 25% sodium methoxide in methanol solution (0.625 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of approximately 1600 g of ethylene oxide (resulting in a total of about 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 66 g methanesulfonic acid (0.625 moles). The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

What is claimed is:

1. A nonaqueous, liquid, heavy-duty detergent composition in the form of a stable suspension of solid, substantially insoluble particulate material dispersed throughout a structured, surfactant-containing liquid phase, wherein:

A) said composition comprises from about 55% to 98.9% by weight of the composition of a structured, surfactant-containing liquid phase formed by combining:

i) from about 1% to 80% by weight of said liquid phase of one or more nonaqueous organic diluents; and ii) from about 20% to 99% by weight of said liquid phase of a surfactant selected from anionic, nonionic and cationic surfactants and combinations thereof, wherein said surfactant comprises from about 0.45% to 45% by weight of composition of C10–C16 linear allyl benzene sulfonate particles having a particle size range of 0.1 to 2000 microns, said particles being substantially insoluble in said diluent, B) from about 0.1% to about 10%, by weight of the detergent composition of an ethoxylated quaternized amine clay soil removal material selected from the group consisting of compounds having the general formula:

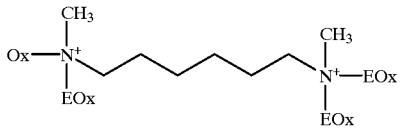

wherein each x is independently less than about 16;

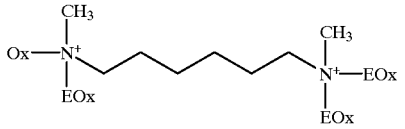

wherein each x is independently greater than about 35;

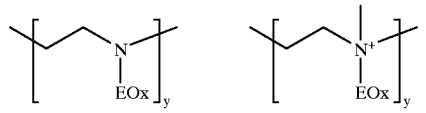

wherein x is from about 10 to about 14, y is from out 12 to about 16, and from about 16% to about 24% of the nitrogens are quaternized, and mixtures thereof, wherein the ethoxylated quaternized amine clay soil removal material is a material that does not change between liquid and solid phase over the temperature range of from about 4° C. to about 35° C.; and C) from about 1% to 50% by weight of the detergent composition of particulate material which ranges in size from about 0.1 to 1500 microns, the particulate material being substantially insoluble in the liquid phase and the particulate material being selected from peroxygen bleaching agents, bleach activators, organic detergent builders, inorganic alkalinity sources, colored speckles and combinations thereof.

2. The nonaqueous, liquid, heavy-duty detergent composition of claim 1 wherein said composition further comprises a mannanase enzyme.

* * * * *